United States Patent [19]

Filomeno

[11] Patent Number: 4,844,005

[45] Date of Patent: Jul. 4, 1989

[54] PAINT SPRAYING TIRE PROTECTION COVER

[76] Inventor: James V. Filomeno, 289 Burgher Ave., Staten Island, N.Y. 10305

[21] Appl. No.: 179,044

[22] Filed: Apr. 8, 1988

[51] Int. Cl.[4] ..... B05C 21/00

[52] U.S. Cl. ..... 118/504; 118/505; 150/166; 296/136

[58] Field of Search ..... 118/504, 505; 150/52 K; 296/136

[56] References Cited

U.S. PATENT DOCUMENTS

| | | | |
|---|---|---|---|
| 2,552,287 | 5/1951 | Layne | 118/505 |
| 2,728,323 | 12/1955 | Walton et al. | 118/505 |
| 2,930,348 | 3/1960 | Fannin | 118/505 |
| 4,455,964 | 6/1984 | Weber | 118/505 X |
| 4,715,646 | 12/1987 | Goffer et al. | 150/52 K X |

*Primary Examiner*—Shrive Beck
*Assistant Examiner*—Alain Bashore
*Attorney, Agent, or Firm*—Richard L. Miller

[57] ABSTRACT

This tire protection cover is designed to prevent paint from being sprayed onto tires of an automobile when the automobile is being painted. Primarily, the device is a shell that covers the tire to block paint spray, and the shell is further provided with pivotal chocks for wheel rolling prevention. In one embodiment a pocket secured to the shell also provides for the placement of work sheets, etc. In another embodiment the tire protection cover comprises a thin flexible sheet of plastic material having an annular elastic band fixedly secured in a rim portion.

4 Claims, 1 Drawing Sheet

PAINT SPRAYING TIRE PROTECTION COVER

BACKGROUND OF THE INVENTION

The instant invention relates generally to automotive vehicle tires, and more particularly, to a paint spraying protection cover.

Numerous devices have been provided in the prior art that are adapted to protect vehicle tires. For example, U.S. Pat. Nos. 3,854,448 of Kromanaker, 3,141,794 of Horner, and 3,001,509 of Carpenter et al, all are illustrative of such prior art. While these units may be suitable for the particular purpose to which they address, they would not be as suitable for the purpose of the present invention as hereafter described.

SUMMARY OF THE INVENTION

A primary object of the present invention is to provide a paint spraying tire protection cover that will overcome the shortcomings of the prior art devices.

Another object is to provide a paint spraying tire protection cover that will effectively cover a tire and will also have chocks for vehicle rolling prevention when it is being painted.

An additional object is to provide a paint spraying tire protection cover that will also include a pocket for the storage of work sheets, etc.

A further object is to provide a paint spraying tire protection cover that is simple and easy to use.

A still further object is to provide a paint spraying tire protection cover that is economical in cost to manufacture.

Further objects of the invention will appear as the description proceeds.

To the accomplishment of the above and related objects, this invention may be embodied in the form illustrate in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
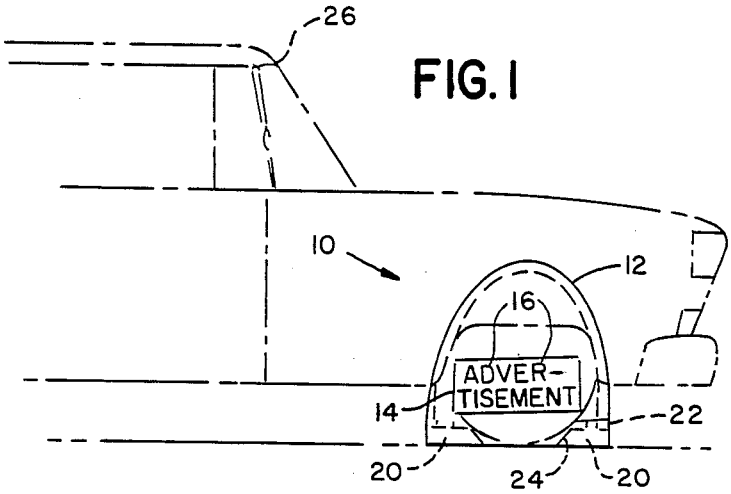
FIG. 1 is a front view of the instant invention in operative employment, the vehicle being illustrated fragmentary and in phantom.

Turning now descriptively to the drawings, in which like reference characters denote like elements throughout the several views, a protective cover 10 is shown to include a shell 12 preferably fabricated of plastic. A pocket 14 is fixedly secured to the outer peripheral surface of shell 12 that is concave on its rear side, and letter characters 16 are imprinted on the front convex side, for advertising a body shop name, etc. A base portion 18 is fixedly secured to the bottom sides of shell 12, and a chock 20 is pivotally secured to the rear of each base portion 18 by hinges 22, the pair of chocks 20 serving to prevent the wheel 24 of vehicle 26 from rolling when engaged therewith.

It shall be noted that pocket 14 may be employed to contain work sheets, etc.

To employ a set of covers 10, each one is placed with its concave side towards and in alignment with a wheel 24 with the chocks 20 pivoted upward. The shell 12 is then urged inward with the rounded top portion tilted to enter the cut-out of the fender of the vehicle 26. The base portion 18 are then rested on the ground and the shell 12 is urged towards the wheel 24. Following the above, the chocks 20 are pivoted down in the front and rear portions of the tire.

Figure 3:
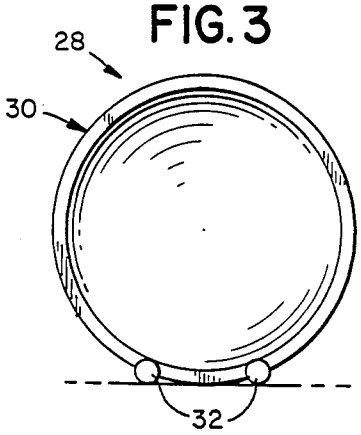
FIG. 3 is a front view of a first modified form of the invention.
Figure 4:
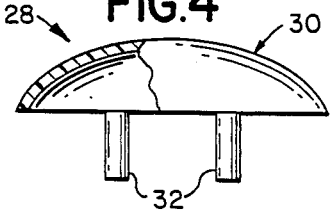
FIG. 4 is a top plan view of FIG. 3, shown partly broken away.
Figure 2:
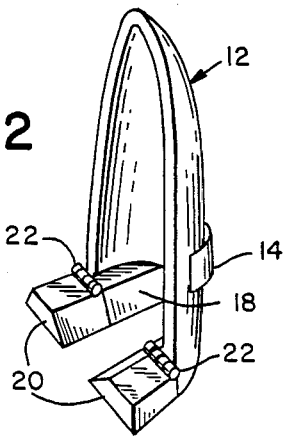
FIG. 2 is a perspective of the invention per se.

Referring now to FIGS. 3 and 4, a first modified form of cover 28 includes a circular shell 30 that is concave on one side and is provided with a pair of spaced and projecting chocks 32 that are circular in cross-sectional configuration.

In use, shell 30 performs the same function described of 12, with the exception, the chocks 32 are fixed and no pocket is provided.

Figure 5:
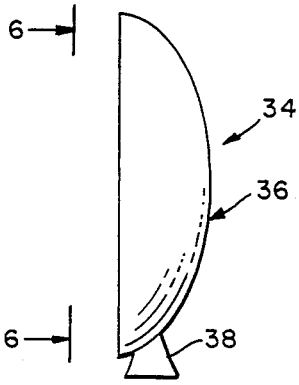
FIG. 5 is a side elevational view of a second modified form of the invention.
Figure 6:
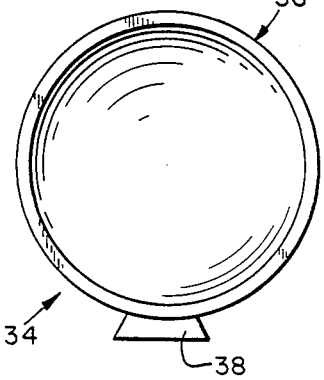
FIG. 6 is a view taken in the direction of arrow 6 in FIG. 5.

Looking now at FIGS. 5 and 6, a second modified form of cover 34 consists of a circular and concave shell 36 having a central base pedestal 38 fixedly secured to its outer rim portion.

In employment, cover 34 functions in the same manner described of 10 and 28, the only exception being, that a base pedestal 38 is provided for its support, rather than chocks.

Figure 7:
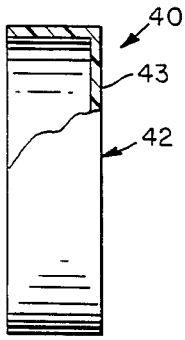
FIG. 7 is a side elevational view of a third modified form of the invention.

Referring now to FIG. 7, a third modified form of cover 40 consists of circular and hollow cylindrical shell 42 with an integrally attached end wall 43 that provides for covering a wheel of a vehicle.

Figure 9:
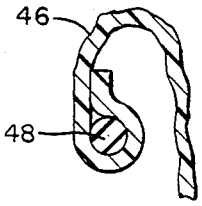
FIG. 9 is a greatly enlarged and fragmentary cross sectional view, of the area in the dotted circle 9 of FIG. 8.
Figure 8:
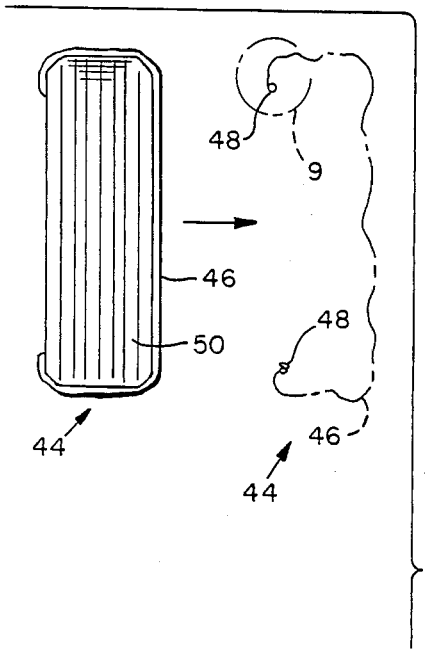
FIG. 8 is a side view of a forth modified form of the invention, showing its removal from the tire in phantom.

In use, cover 40 covers a wheel for protection, by pushing the open end of shell 42 into engagement with a wheel. Referring to FIGS. 8 and 9, a fourth modified form of cover 44 consists of a thin flexible sheet 46 of plastic material having an annular elastic band 48 fixedly secured in a rim portion.

In use, sheet 46 is engaged over tire 50 and the elastic band 48 serves to keep it in place.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A paint spraying tire protection cover, comprising, a shell, a pocket secured to said shell, providing retainment for articles, a pair of base portions secured to said shell, providing ground support means for said shell, and a pair of chocks secured to said base portions, providing rolling prevention means for an automotive vehicle wheel.

2. A paint spraying tire protection cover as set forth in claim 1, wherein each base portion of said pair of base portions is fixedly secured to a bottom of said shell in a concave portion of said shell, and a top portion of said shell is rounded for easy insertion in a cut-out in a body of said vehicle.

3. A paint spraying tire protection cover as set forth in claim 2, wherein one chock projects from and is fixedly secured to an end of each said base portion and is hinged pivotally to each said base portion by a hinge fixedly secured to said end of each said base portion and said chocks.

4. A paint spraying tire protection cover, comprising, a circular and concave shell, and a pair of projecting and spaced apart chocks for a wheel are fixedly secured to an outer peripheral rim surface of said shell of said cover.

* * * * *